US007363933B2

(12) United States Patent
Carter

(10) Patent No.: US 7,363,933 B2
(45) **Date of Patent: *Apr. 29, 2008**

(54) ERECTABLE CANOPY WITH REINFORCED ROOF STRUCTURE

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 0 days.

This patent is subject to a terminal disclaimer.

(21) Appl. No.: 11/645,108

(22) Filed: Dec. 22, 2006

(65) Prior Publication Data

US 2007/0119493 A1 May 31, 2007

Related U.S. Application Data

(63) Continuation of application No. 11/080,106, filed on Mar. 15, 2005, now Pat. No. 7,178,541, which is a continuation of application No. 10/613,632, filed on Jul. 3, 2003, now Pat. No. 6,874,520, which is a continuation of application No. 10/214,699, filed on Aug. 8, 2002, now Pat. No. 6,601,599, which is a continuation of application No. 09/624,821, filed on Jul. 25, 2000, now Pat. No. 6,470,902, which is a continuation-in-part of application No. 09/490,860, filed on Jan. 24, 2000, now Pat. No. 6,382,224, which is a continuation-in-part of application No. 09/131,148, filed on Aug. 7, 1998, now Pat. No. 6,041,800, and a continuation-in-part of application No. 09/277,250, filed on Mar. 26, 1999, now Pat. No. 6,076,312, which is a continuation of application No. 09/025,897, filed on Feb. 18, 1998, now Pat. No. 5,921,260, which is a continuation of application No. 08/823,616, filed on Mar. 25, 1997, now Pat. No. 5,797,412, which is a continuation of application No. 08/604,801, filed on Feb. 23, 1996, now Pat. No. 5,632,293, which is a continuation of application No. 08/279,476, filed on Jul. 25, 1994, now Pat. No. 5,511,572.

(51) Int. Cl.
*E04H 15/50* (2006.01)

(52) U.S. Cl. ..... 135/145; 135/131; 135/135; 135/147; 403/172; 403/217

(58) Field of Classification Search ..... 135/130–131, 135/135, 143–147, 114, 151–154, 905; 52/645–646, 52/109; 403/170–172, 217–219
See application file for complete search history.

(56) References Cited

U.S. PATENT DOCUMENTS 0,402,755 A 5/1889 Lyon (Continued)

FOREIGN PATENT DOCUMENTS

AU 624796 6/1992

(Continued)

*Primary Examiner*—Winnie Yip
(74) *Attorney, Agent, or Firm*—Fulwider Patton LLP

(57) ABSTRACT

The quickly erectable canopy shelters include a plurality of legs connected together by an extendible perimeter assembly of link members. The roof structure is formed by a pole members pivotally mounted to the upper ends of the legs so as to extend across the shelter, and movable between a lowered position and a raised, upwardly arching position. The pole members are pivotally coupled to a central hub, and each of the pole members is formed of pole sections hinged to permit downward folding and upward unfolding until they are fully extended. Corner support strut members are pivotally mounted to the extendible perimeter assembly of link members adjacent to the legs, to support the pole members. The outer ends of the pole members are pivotally connected to the upper ends of the legs by pivoting link members that pivot between a lowered position and a raised position extending above the legs when the shelter is extended. In the raised position the pivoting link members rotate outwardly to absorb downward forces exerted on the roof structure and transmitted outwardly by the pole members.

13 Claims, 8 Drawing Sheets

U.S. PATENT DOCUMENTS

| | | | | | |
|---|---|---|---|---|---|
| 1,712,836 | A | | 5/1929 | Mills | |
| 1,853,367 | A | * | 4/1932 | Mace | 135/123 |
| 2,137,625 | A | * | 11/1938 | Norvell | 135/147 |
| 2,723,673 | A | * | 11/1955 | Call | 135/140 |
| 2,989,329 | A | | 6/1961 | Noah | |
| 3,810,482 | A | | 5/1974 | Beavers | |
| 4,125,249 | A | | 11/1978 | Zen | |
| 4,407,317 | A | | 10/1983 | Crandall | |
| 4,450,971 | A | | 5/1984 | Kashiwabara | |
| 4,601,301 | A | * | 7/1986 | Hermanson | 135/25.2 |
| 4,607,656 | A | * | 8/1986 | Carter | 135/145 |
| 4,641,676 | A | | 2/1987 | Lynch | |
| 4,779,635 | A | * | 10/1988 | Lynch | 135/97 |
| 4,827,958 | A | | 5/1989 | Cantwell et al. | |
| 4,877,044 | A | | 10/1989 | Cantwell et al. | |
| 4,885,891 | A | | 12/1989 | Lynch | |
| 4,941,500 | A | | 7/1990 | Emard | |
| 4,945,584 | A | | 8/1990 | LaMantia | |
| 4,947,884 | A | * | 8/1990 | Lynch | 135/97 |
| 4,950,100 | A | | 8/1990 | Horgas | |
| 5,022,420 | A | | 6/1991 | Brim | |
| 5,035,253 | A | * | 7/1991 | Bortles | 135/119 |
| 5,069,238 | A | | 12/1991 | Marks | |
| 5,069,572 | A | | 12/1991 | Niksic | |
| 5,244,001 | A | * | 9/1993 | Lynch | 135/145 |
| 5,274,980 | A | * | 1/1994 | Zeigler | 52/646 |
| 5,275,188 | A | * | 1/1994 | Tsai | 135/97 |
| 5,361,794 | A | | 11/1994 | Brady | |
| 5,421,356 | A | * | 6/1995 | Lynch | 135/145 |
| 5,423,341 | A | | 6/1995 | Brady | |
| 5,485,863 | A | * | 1/1996 | Carter | 135/145 |
| 5,490,533 | A | * | 2/1996 | Carter | 135/145 |
| 5,511,572 | A | * | 4/1996 | Carter | 135/145 |
| 5,632,292 | A | | 5/1997 | Carter | |
| 5,632,293 | A | | 5/1997 | Carter | |
| 5,634,483 | A | * | 6/1997 | Gwin | 135/131 |
| 5,638,853 | A | * | 6/1997 | Tsai | 135/145 |
| 5,701,923 | A | * | 12/1997 | Losi et al. | 135/131 |
| 5,794,640 | A | * | 8/1998 | Jang | 135/131 |
| 5,797,412 | A | | 8/1998 | Carter | |
| 5,813,425 | A | | 9/1998 | Carter | |
| 5,934,301 | A | * | 8/1999 | Carter | 135/145 |
| 5,944,040 | A | * | 8/1999 | Jang | 135/126 |
| 6,035,877 | A | * | 3/2000 | Losi et al. | 135/131 |
| 6,076,312 | A | * | 6/2000 | Carter | 52/145 |
| 6,089,247 | A | * | 7/2000 | Price | 135/145 |
| 6,148,835 | A | * | 11/2000 | Rhee | 135/145 |
| 6,173,726 | B1 | * | 1/2001 | Talmadge | 135/144 |
| 6,216,717 | B1 | * | 4/2001 | Chen | 135/130 |
| 6,283,136 | B1 | * | 9/2001 | Chen | 135/144 |
| 6,470,902 | B1 | | 10/2002 | Carter | |

FOREIGN PATENT DOCUMENTS

| | | | |
|---|---|---|---|
| EP | 0305183 | A1 | 3/1989 |
| GB | 753183 | | 7/1956 |
| GB | 002258475 | | 2/1993 |
| GB | 002320509 | | 6/1998 |
| WO | 89/07696 | | 8/1989 |
| WO | 92/12313 | | 7/1992 |
| WO | 9313284 | | 7/1993 |
| WO | 96/41928 | | 12/1996 |
| WO | 01/53635 | A1 | 7/2001 |

* cited by examiner

ERECTABLE CANOPY WITH REINFORCED ROOF STRUCTURE

RELATED APPLICATIONS

This is a continuation of application Ser. No. 11/080,106, filed Mar. 15, 2005, now U.S. Pat. No. 7,178,541, which is a continuation of application Ser. No. 10/613,632, filed Jul. 3, 2003, now U.S. Patent No. 6,874,520, which is a continuation of application Ser. No. 10/214,699, filed Aug. 8, 2002, now U.S. Pat. No. 6,601,599, which is a continuation of application Ser. No. 09/624,821, filed Jul. 25, 2000, now U.S. Patent No. 6,470,902, which is a continuation in part of application Ser. No. 09/490,860, filed Jan. 24, 2000, now U.S. Pat. No. 6,382,224, which is a continuation in part of application Ser. No. 09/131,148, filed Aug. 7, 1998, now U.S. Pat. No. 6,041,800, and a continuation in part of application Ser. No. 09/277,250, filed Mar. 26, 1999, now U.S. Pat. No. 6,076,312, which is a continuation of application Ser. No. 09/025,897, filed Feb. 18, 1998, now U.S. Pat. No. 5,921,260, which is a continuation of application Ser. No. 08/823,616, filed Mar. 25, 1997, now U.S. Pat. No. 5,797,412, which is a continuation of application Ser. No. 08/604,801, filed Feb. 23, 1996, now U.S. Pat. No. 5,632, 293, which is a continuation of application Ser. No. 08/279, 476, filed Jul. 25, 1994, now U.S. Pat. No. 5,511,572.

BACKGROUND OF THE INVENTION

1. Field of the Invention

This invention relates generally to folding, collapsible structures, and more particularly relates to a collapsible shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One known quickly erectable, collapsible shelter includes a framework of X-shaped linkages, telescoping legs, and a canopy covering the framework. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter.

In order to increase the portability and versatility of such temporary shelters, it is important that they be not only lightweight and small enough in a folded, compact configuration so that can be readily transported and carried, but also large enough and with sufficient headroom when unfolded for a group of people to stand underneath them. As such structures have become larger and more lightweight, reinforcing features that contribute to strength, roominess, and ease of use in setting up and taking down such structures have also become increasingly important.

One modern type of tent structure provides a lightweight roof structure with four roof rods joined together at the center by a head connector member, with each of the roof rods formed of two rod members interconnected by intermediate pivot connecting members. The roof rods are supported on top of a base structure formed by four legs and scissors-type linkages connected to a top fixed connector and a lower sliding connector of each leg. Each intermediate pivot connecting member between the individual rod members of the roof rods confines upward rotation of the rod members to an upmost, upwardly arching position, but allows the roof rods to be folded downwardly when the tent is collapsed. Reinforcing linking rods provided at the corners of the roof structure are coupled at one end to the lower sliding connectors on the legs, and are slidingly coupled at the other end to the roof rods, to assist in stabilizing the roof rods in the upwardly arched position when the shelter is fully unfolded and extended. However, the slidable coupling of the corner linking rods must slide over a considerable length of the roof rods, which can lead to abrasion and wear of the roof rods and eventually interfere with the sliding of the linking rods during setting up and taking down of the structure, without providing any significant reinforcing strength or vertical support of the roof structure when the shelter is fully unfolded and extended.

Lightweight shelters with raised roof structures are particularly useful for holding gatherings in inclement weather, to provide needed headroom and shed precipitation and debris, but raised roof structures can be particularly vulnerable to downward forces placed on a roof structure by strong winds. One approach to providing a lightweight shelter with a raised roof structure has been to make the roof structure flexible so that it can move between a raised, upwardly arching configuration when weather permits, and a lowered, downwardly arching configuration, if the downward component of the wind is sufficiently strong, to automatically present a reduced profile to strong winds when necessary. However, in some shelter structures, a downward force on the canopy, such as can occur due to wind pressure, for example, can result in the transmission of excessive outward forces to the upper legs and upper brackets to which the roof structure is mounted, requiring extra strengthening or bracing of these sections of the shelter to resist such outwardly directed forces. There thus remains a need for an improved, reinforced raised roof structure for such lightweight canopy shelters that will permit the raised roof structure to withstand greater wind pressures, to be able to provide a desired headroom and shed precipitation and debris under a wider variety of weather situations. The present invention meets these and other needs.

SUMMARY OF THE INVENTION

Briefly, and in general terms, the present invention provides for an improved, lightweight erectable canopy shelter with a reinforced raised roof structure that is strengthened and stabilized to permit the roof structure to remain in a raised configuration in order to provide adequate headroom and adequately shed debris and precipitation, and to resist downward wind pressures on the roof structure.

The present invention accordingly provides, in one preferred embodiment, for an improved, lightweight and quickly erectable canopy shelter with a reinforced roof structure. The roof structure of the shelter is supported by a plurality of legs having upper and lower ends connected together by an extendible perimeter assembly of link members. In one currently preferred approach, the perimeter assembly of link members comprises pairs of link members being pivotally connected together in a scissors linkage configuration so as to be extendable from a first collapsed position extending horizontally between adjacent pairs of legs to a second extended position extending horizontally between the adjacent pairs of legs. A slider member is slidably mounted to each of the legs, and in a presently preferred aspect, the legs of the shelter comprise telescoping upper and lower sections, with the slider members mounted to upper sections of the legs. The pairs of link members of the extendible perimeter assembly preferably comprise first and second link members, with the first link member having an outer end pivotally connected to the upper end of a leg, and the second link member having an outer end pivotally connected to a slider member of a leg, and with the pairs of link members connected together at their inner ends.

In a preferred embodiment of the invention, the roof structure of the shelter is preferably provided by a canopy assembly comprised of a plurality of pole members having their outer ends pivotally mounted to the upper ends of the legs so as to extend across the shelter, and to be movable between a lowered position when the shelter is in its folded and unextended configuration, and a raised, upwardly arching position when the shelter is unfolded and extended, in which position a canopy cover may be placed over the roof structure of the canopy shelter. In a presently preferred aspect, the outer ends of the pole members are pivotally connected to the upper ends of the legs by pivoting link members that pivot between a lowered position when the shelter is unextended, and a raised position extending above the legs when the shelter is extended. In the extended configuration, the pivoting link members can advantageously rotate outwardly to accommodate downward forces exerted on the roof structure and transmitted outwardly by the pole members.

In a presently preferred aspect of the invention, the pole members are pivotally coupled at their inner ends to a central hub connector, and each of the pole members comprises a plurality of pole sections hingedly coupled together permitting inward, downward folding of the pole members to a folded configuration, and limiting upward unfolding of the pole members to a fully extended configuration.

In a preferred embodiment of the invention, corner support strut members are also advantageously provided for reinforcing and stabilizing the pole members of the canopy assembly when the shelter is unfolded and extended. The outer ends of the support strut members are pivotally mounted to the extendible perimeter assembly of link members adjacent to the legs. In one presently preferred embodiment, the support strut members may be pivotally mounted to a crank rotatably mounted to a telescoping shaft connected between two adjacent link members connected to a leg. In another presently preferred embodiment, the support strut members may be pivotally connected to a link member adjacent to a leg. In one presently preferred embodiment, the support strut members are permanently pivotally connected to the pole members, and the support strut members may be formed of telescoping sections. Thus, when the canopy assembly is unfolded and extended, the corner support struts rotate upwardly to support the pole members, and in a preferred aspect, the inner ends of the strut members each have a support bracket permanently pivotally connected to a corresponding pole member to support the pole member in the raised, upwardly extending position.

From the above, it may be seen that the present invention represents important benefits over the prior art. By using a pivotal link at the outer ends of the roof rods where they meet the top of the legs, direct outward force on the top of the legs is substantially reduced from vertical force applied to the roof compared to prior art designs. This substantially improves the ability of the structure to absorb such forces without deflection of the primary support structure. Furthermore, in preferred embodiments, the termination of the support struts at a location offset from the slider provides important benefits to the stability of the structure during erection and when the canopy is fully erected.

These and other aspects and advantages of the invention will become apparent from the following detailed description and the accompanying drawings, which illustrate by way of example the features of the invention.

DETAILED DESCRIPTION OF THE PREFERRED EMBODIMENTS

As attempts have been made to improve portability and expansion of quickly erectable temporary shelter structures, maximizing extended dimension and minimizing weight, modification of roof structures of such shelters to provide adequate headroom, shed precipitation and debris, and to withstand strong winds under a variety of conditions has become increasingly important.

Figure 1:
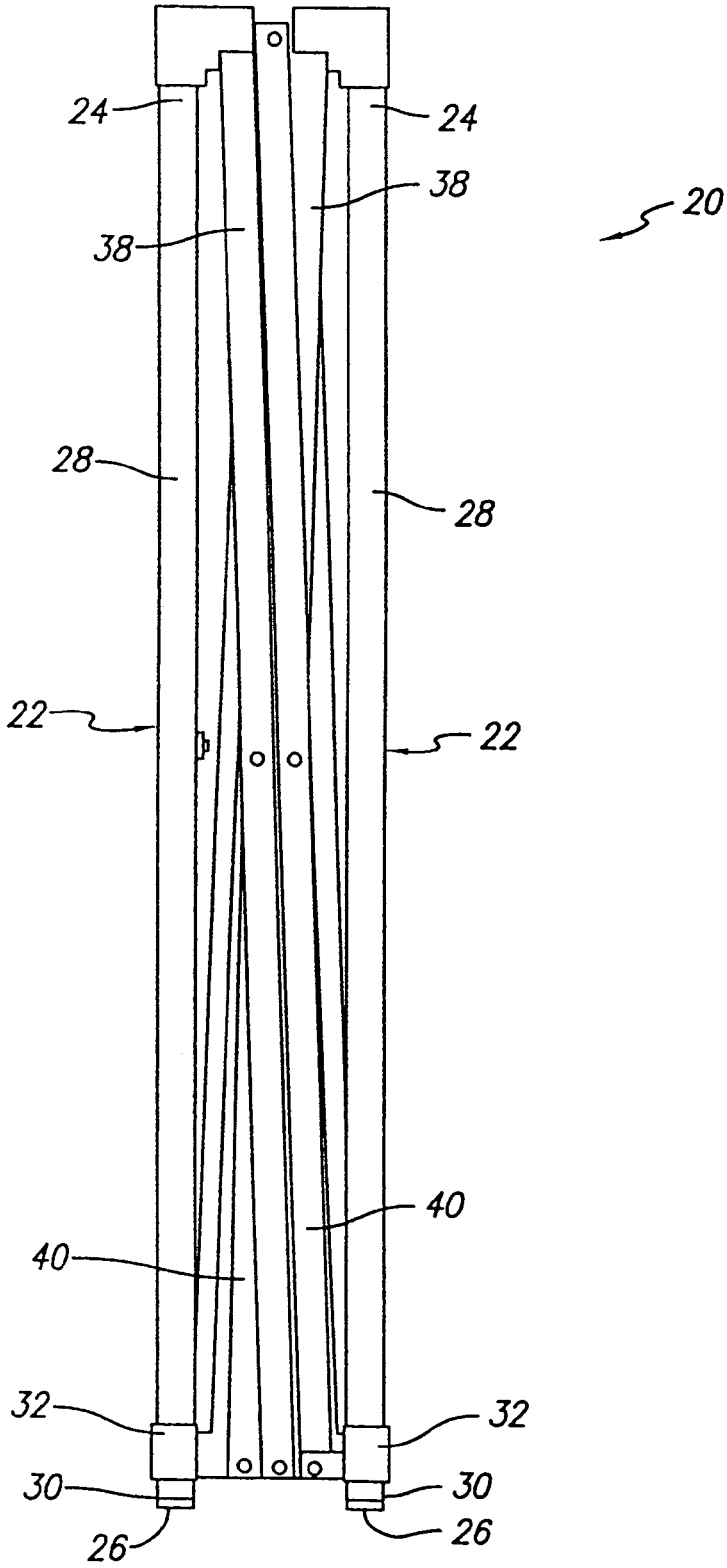
FIG. 1 is a side elevational view of the quickly erectable canopy shelter of the invention.
Figure 2:
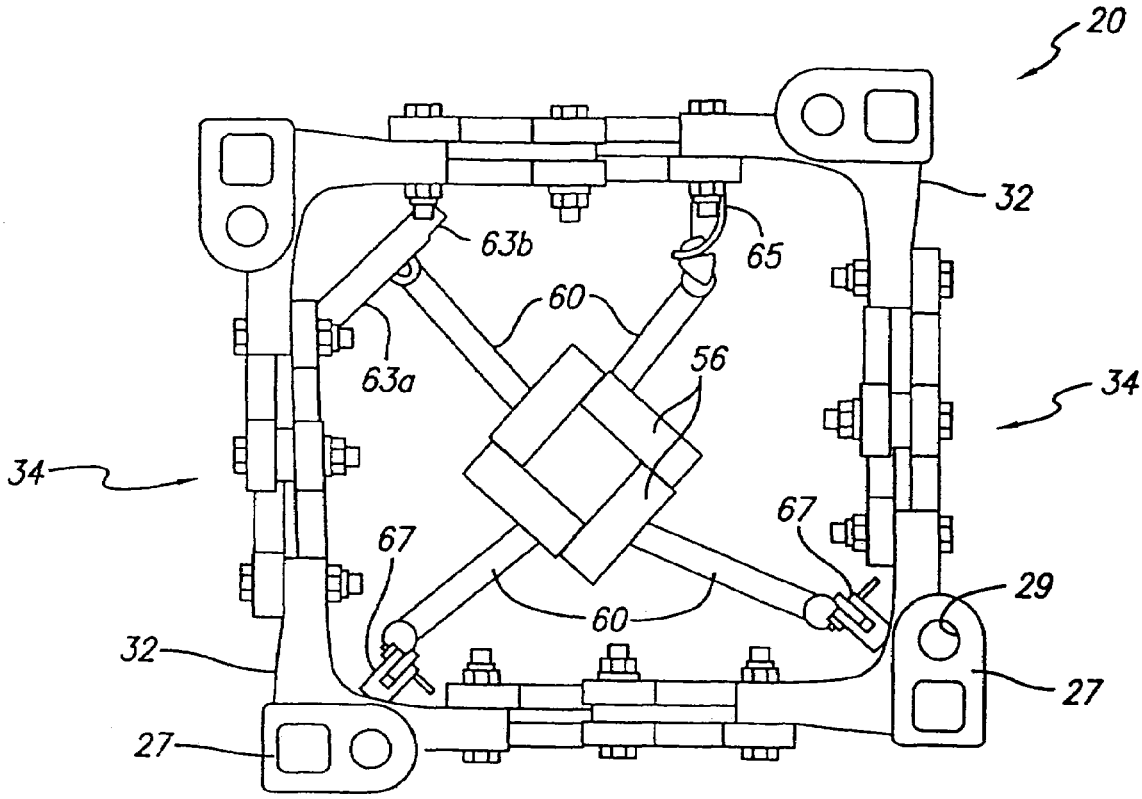
FIG. 2 is a bottom plan view of the quickly erectable canopy shelter of FIG. 1 in a folded configuration.
Figure 3:
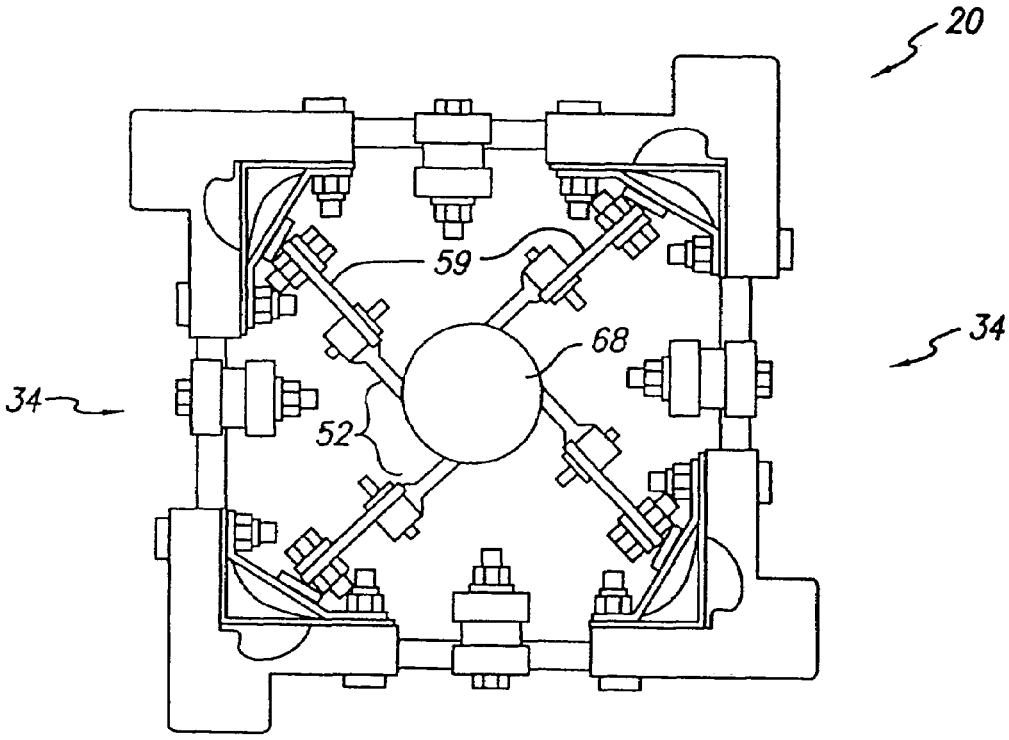
FIG. 3 is a top plan view of the quickly erectable canopy shelter of FIG. 1 in a folded configuration.
Figure 4:
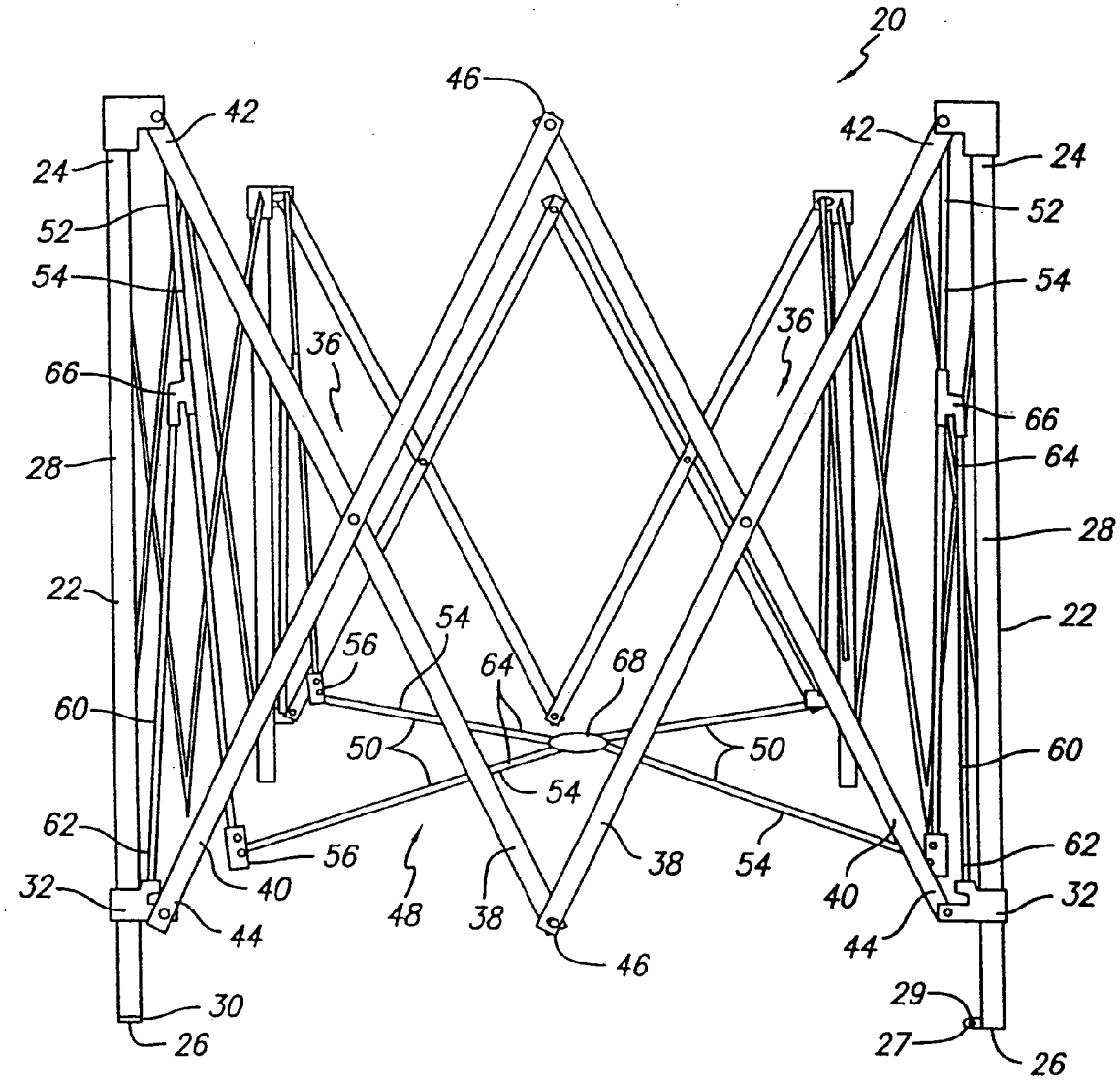
FIG. 4 is a side elevational view of the quickly erectable canopy shelter of FIG. 1 in a partially extended configuration.
Figure 5:
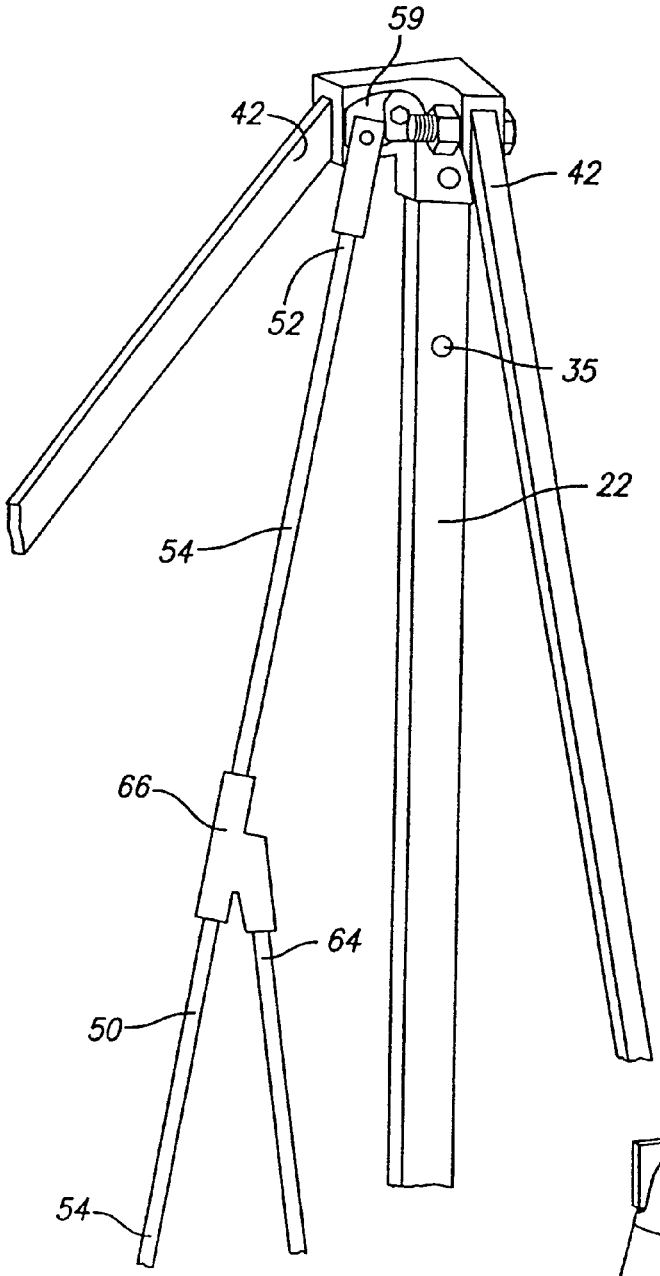
FIG. 5 is a perspective view of an upper corner portion of the quickly erectable canopy shelter of the invention of FIG. 1 in a partially extended configuration.
Figure 6:
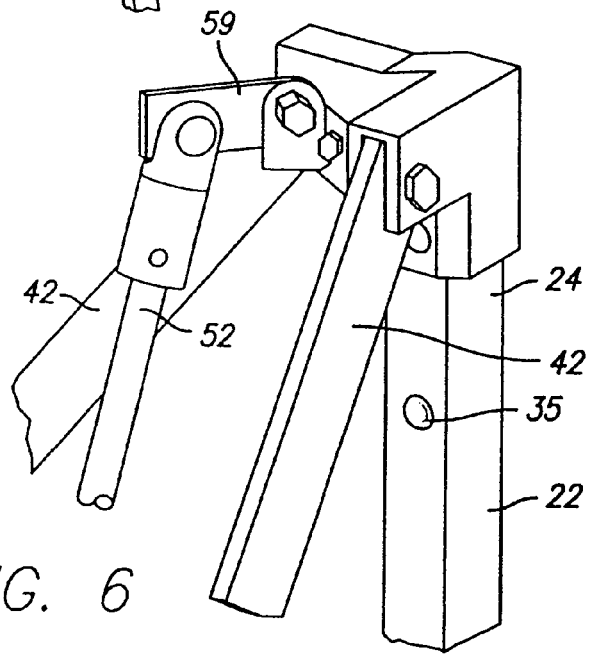
FIG. 6 is an enlarged view of the upper corner portion of the quickly erectable canopy shelter of FIG. 1 as illustrated in FIG. 5.
Figure 7:
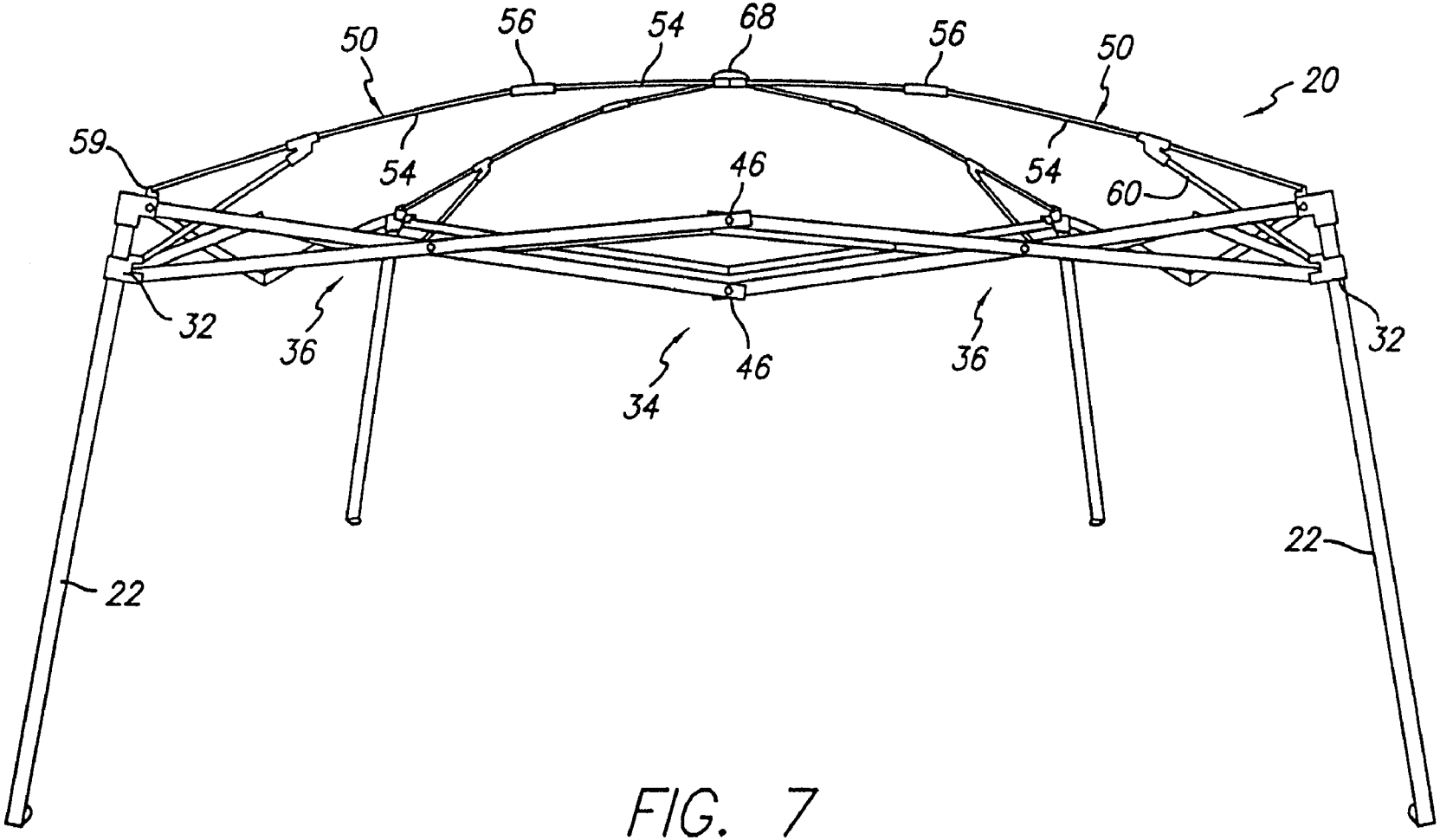
FIG. 7 is a side elevational view of the quickly erectable canopy shelter of FIG. 1 in a fully extended configuration.
Figure 8:
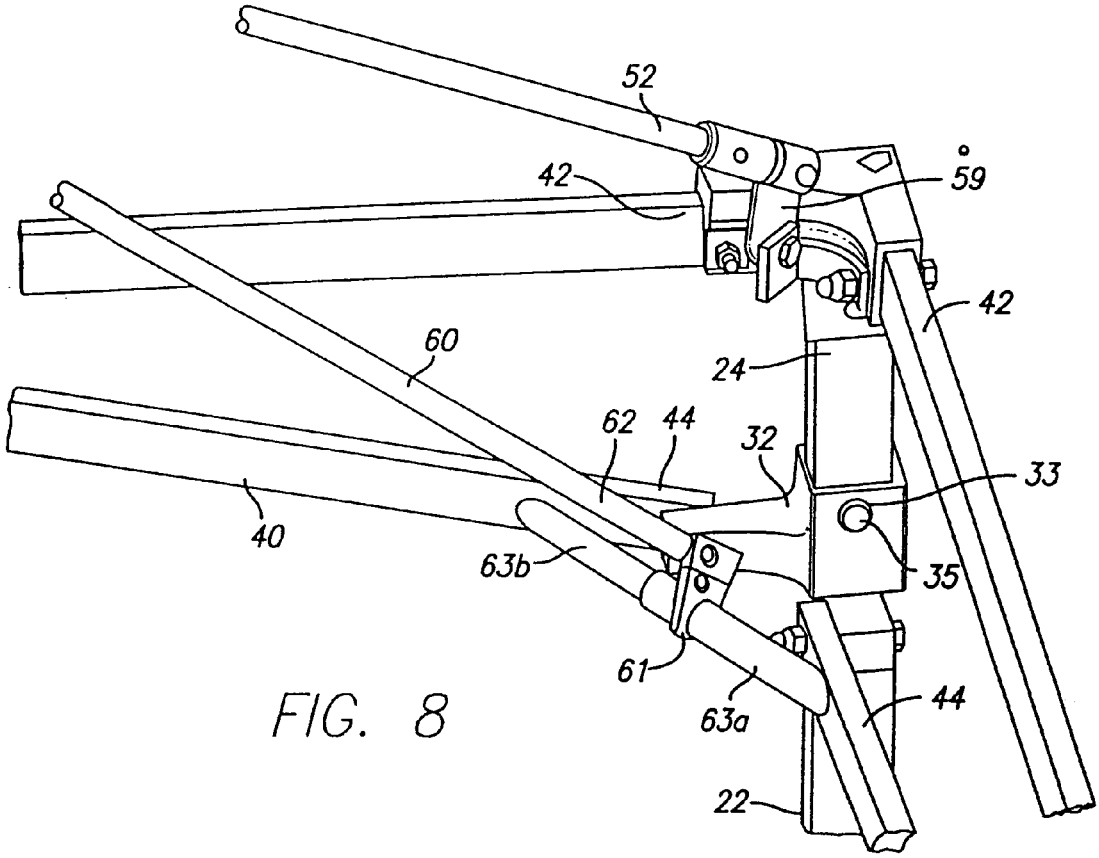
FIG. 8 is an enlarged view of the upper corner of the quickly erectable canopy shelter of FIG. 1, in a fully extended configuration, and showing a preferred mounting of the lower end of a support strut member.

As is illustrated in the drawings, in a first presently preferred embodiment, the invention provides for a quickly erectable canopy shelter 20 having a plurality of legs 22, each having an upper end 24 and a lower end 26, as shown in FIG. 1, showing the quickly erectable canopy shelter of the invention in a folded, unexpended configuration. The lower end of each leg also preferably has foot 27 with an aperture 29 for securing the feet to a substrate surface. The collapsible shelter preferably has four legs, but can also have three, five, or more legs. The legs are also preferably hollow. Each leg also preferably has an upper section 28 and a telescoping lower section 30, with a slider member 32 slidably mounted to the upper section of each of the legs. The telescoping lower sections preferably include a spring loaded. detent pin (not shown) for indexing in a corresponding aperture (not shown) in the corresponding upper section of the legs. The leg slider members each preferably also have an aperture 33 for indexing with a corresponding spring loaded detent pin 35 of the legs. As is best seen in FIGS. 2, 3, 4, 7 and 11, an extendible perimeter assembly 34 of link members connects adjacent legs together. In a presently preferred embodiment, the extendible perimeter assembly of link members is formed by pairs of link members 36 pivotally connected together, with the pairs of link members including a first link member 3 8 and second link member 40. The first link member has an outer end 42 pivotally connected to the upper end of a leg, and the second link member has an outer end 44 pivotally connected to a slider member of a leg. The pairs of link members are preferably connected together in a scissors configuration so as to be extendable from a first collapsed position extending horizontally between adjacent pairs of legs to a second extended position extending horizontally between the adjacent pairs of legs. In a presently preferred aspect, the pairs of link members are connected together at their inner ends 46.

As is best seen in FIGS. 3, 4, 7 and 11, a roof structure is provided by a canopy assembly 48 that is supported by the legs. The canopy assembly preferably comprises a plurality of pole members 50 having their outer ends 52 mounted to the legs, as is best seen in FIGS. 5, 6, 8, 9, 10, and 12, to extend across the shelter, and that are movable between a lowered position, best shown in FIGS. 4, 5 and 6, and a raised, upwardly extending position, best illustrated in FIGS. 7-12. Each of the pole members currently preferably comprises a plurality of pole sections 54 pivotally joined together at hinges or joints 56 permitting inward, downward folding of the pole members to a folded configuration, and limiting upward unfolding of the pole members to a fully extended configuration. As is best seen in FIGS. 3, and 5-12, the outer ends of the pole members are not directly connected to the upper ends of the legs as in prior art designs, but are preferably indirectly connected to the upper ends of the legs by a pivoting link member 59 that pivots between a lowered position when the shelter is unextended, and a raised position extending above the legs when the shelter is extended. In the extended configuration, the pivoting link members can advantageously rotate outwardly to accommodate downward forces exerted on the roof structure that are transmitted outwardly by the pole members, as is indicated by the arrows representing the downward movement of the roof structure and the outward rotation of the pivoting link members in FIGS. 11 and 12, such as may occur due to wind pressure on the roof structure of the shelter. This configuration of the invention thus avoids directly transmitting outward forces to the upper ends of the legs as in prior art designs.

A plurality of support strut members 60 are also provided, as can best be seen in FIGS. 2, 4, 5 and 7-12, with the outer ends 62 of the support strut members pivotally mounted to the legs below the pole members, and preferably each support strut member is pivotally mounted adjacent to a leg. In one presently preferred embodiment, illustrated in FIG. 8, the support struts are pivotally mounted to a crank 61 rotatably mounted to a telescoping shaft 63*a,b* for rotation about the telescoping shaft. The telescoping shaft is mounted, such as by welding, to the outer ends 44 of the second link members 40.

Figure 9:
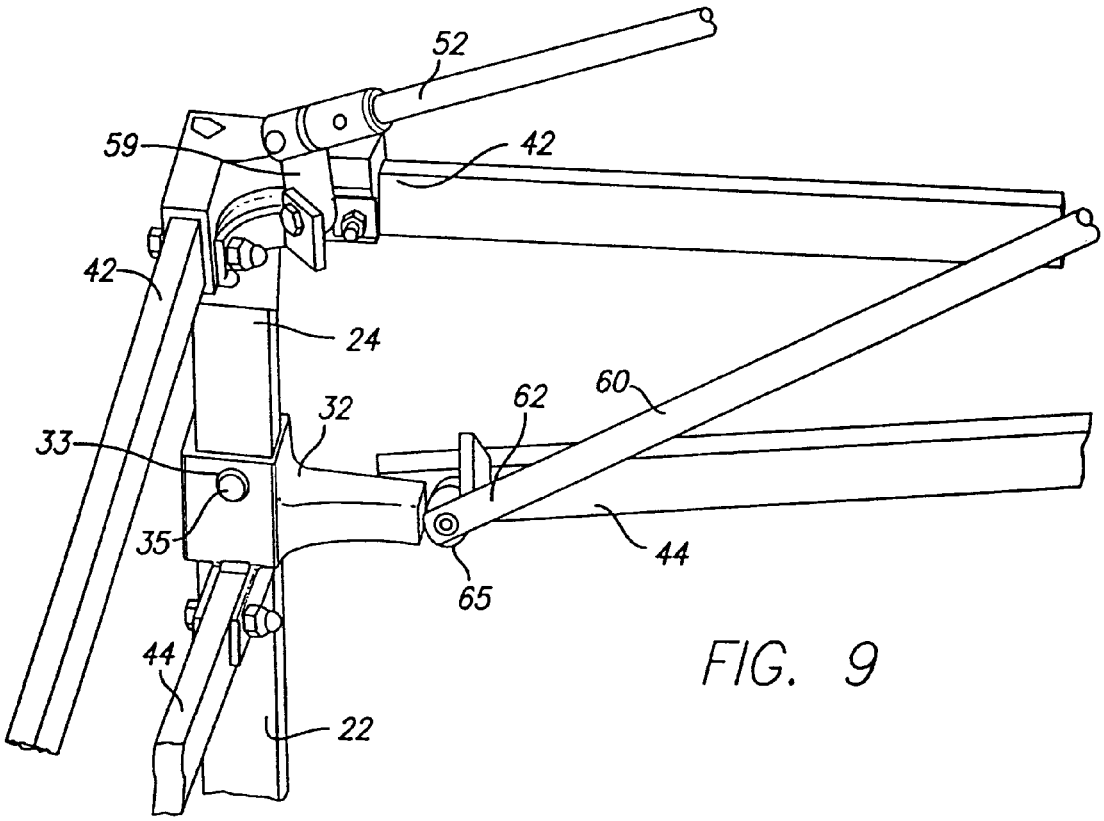
FIG. 9 is an enlarged view of the upper corner of the quickly erectable canopy shelter of FIG. 1, in a fully extended configuration, and showing an alternate preferred mounting of the lower end of a support strut member.
Figure 10:
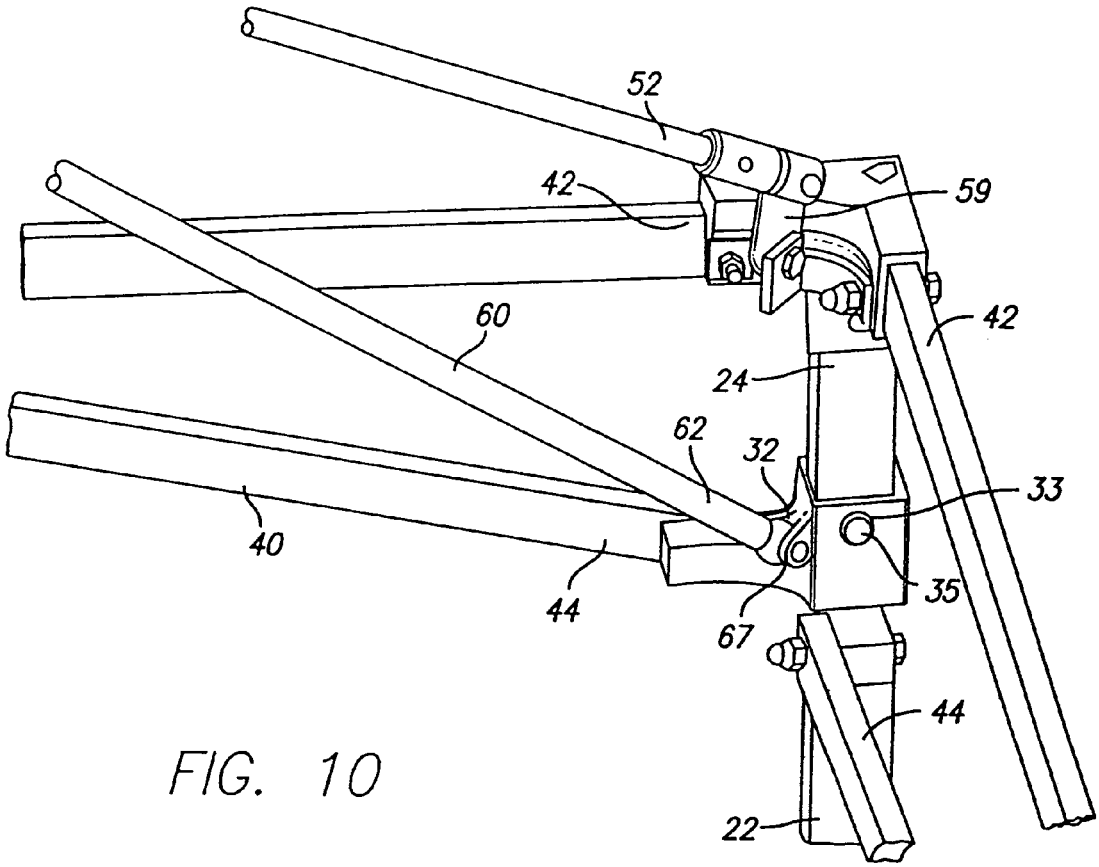
FIG. 10 is an enlarged view of the upper corner of the quickly erectable canopy shelter of FIG. 1, in a fully extended configuration, and showing an alternate mounting of a support strut member.
Figure 12:
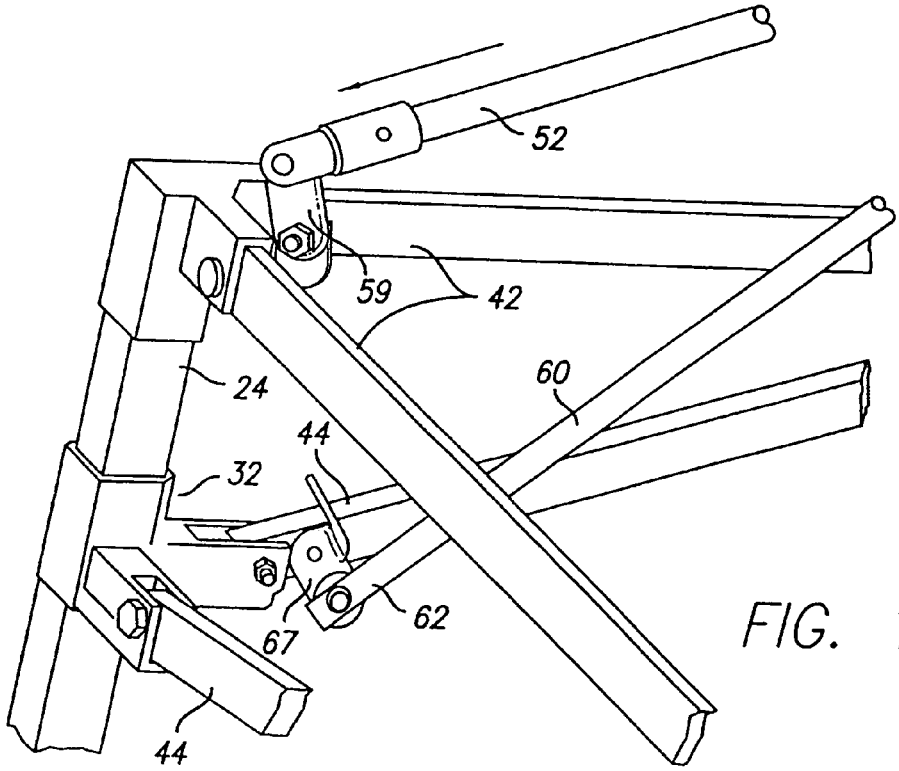
FIG. 12 is an enlarged view of the upper corner of the quickly erectable canopy shelter of FIG. 1, in a fully extended configuration, and showing the outward rotation of the pivoting link members to absorb outward transmission of downward forces on the roof structure by the pole members.
Figure 11:
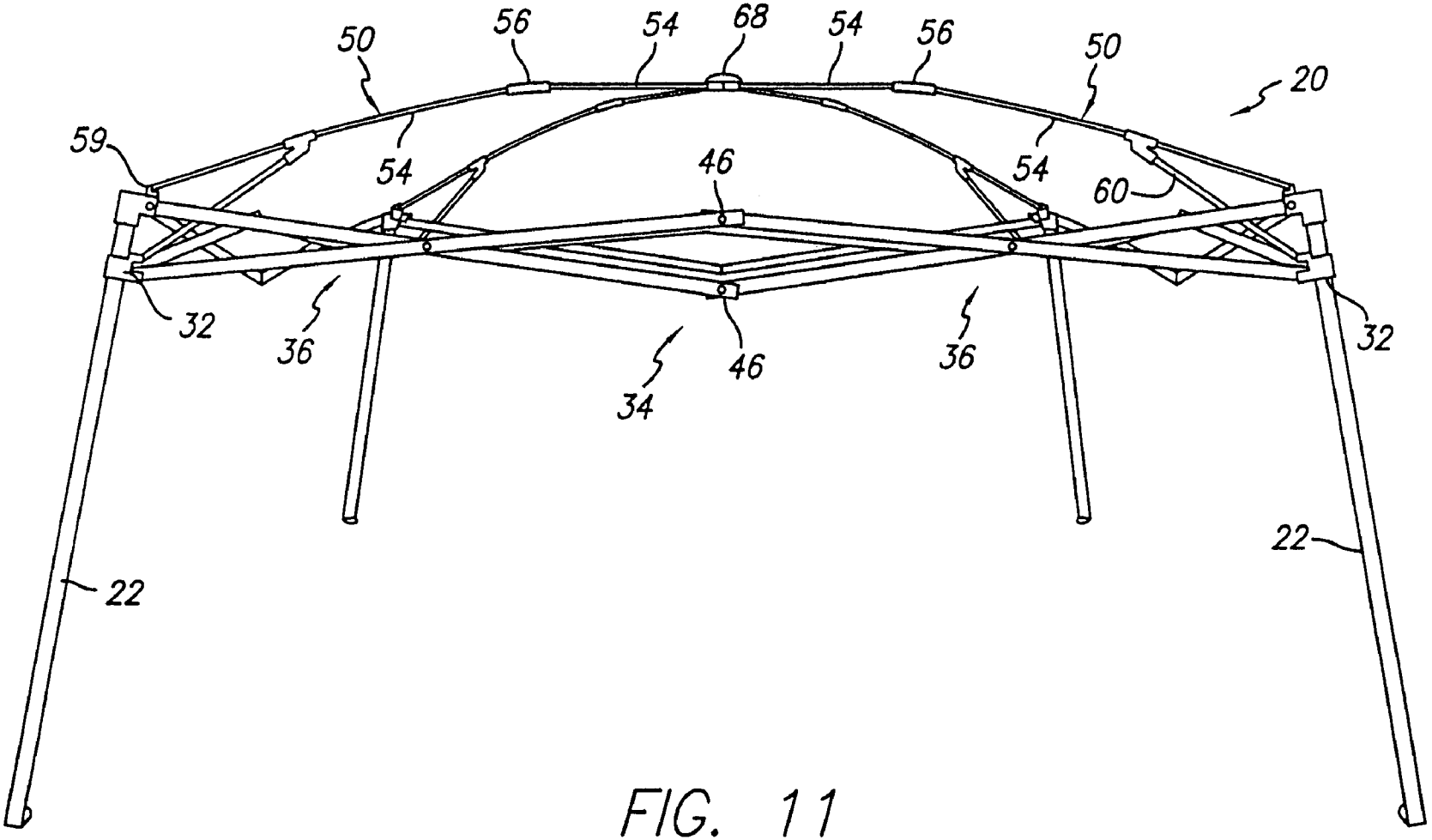
FIG. 11 is a side elevational view of the quickly erectable canopy shelter of FIG. 1 in a fully extended configuration, showing downward flexing of the roof structure due to a downward force.

In another presently preferred embodiment, the outer ends 62 of the support strut members 60 may be pivotally mounted by a bracket 65 affixed, such as by welding or by a bolt, for example, to the outer end 44 of a second link member adjacent to a leg, as is illustrated in FIGS. 9 and 12. In an alternate embodiment, the outer ends 62 of the support strut members 60 may be pivotally mounted to a bracket 67 of a slider member, as shown in FIG. 10.

As is best seen in FIGS. 4, 5, 7 and 11, the inner ends 64 of the support strut members are connected to support brackets 66 connecting the support strut members to corresponding pole members to support the pole members in a raised, upwardly extending position. The support strut members also may be formed of telescoping sections. Referring to FIGS. 3, 4, 7 and 11, the inner ends 64 of the pole members are pivotally connected together by a central hub 68. A canopy cover (not shown) may be provided over the roof structure of the shelter to provide a gabled roof surface, to shed precipitation and debris.

From the exemplary illustrations of the presently preferred embodiments, it may be seen that the present invention provides numerous advantages. The indirect pivotal link between the outer end of the roof support rods and the top of the legs prevent the direct application of force to the upper end of the legs due to downward force of the canopy from wind or the like, thus producing a more robust structure capable of absorbing such forces better than prior art designs. Furthermore, the use of offset pivots for the roof support struts further stabilize the structure during and after erection and make the structure more stable during and after erection. Also, the elimination of telescoping components reduces the complexity of the structure, simplifies manufacture, and reduces the chances of binding and other resistance to erection compared to pivoting assemblies.

It will also be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A quickly erectable canopy shelter having an unextended configuration and an extended configuration, comprising:

a plurality of legs having upper and lower ends;

an extendible perimeter assembly of link members connecting said plurality of legs together;

a plurality of pivoting link members pivotally connected to the upper ends of corresponding ones of said legs, respectively; and a canopy assembly including a plurality of pole members having inner and outer ends, the inner ends of said pole members being pivotally connected together by a central hub, the outer ends of said plurality of pole members being pivotally connected to said plurality of pivoting link members, respectively, said plurality of pole members being movable between a lowered position when the shelter is in the unextended configuration and a raised, upwardly extending position extending across the shelter when the shelter is in the extended configuration, and said pivoting link members being rotatable outwardly responsive to downward forces on the canopy assembly.

2. The quickly erectable canopy shelter according to claim 1, further comprising a plurality of support strut members each having an outer end and an inner end, said outer ends of said plurality of support strut members being pivotally mounted to corresponding ones of said legs, and said inner ends being connected to corresponding ones of said pole members to support said pole members when said shelter is in a fully extended configuration, said plurality of support strut members being movable between a lowered position and a raised, upwardly extending position.

3. The quickly erectable canopy shelter according to claim 2, further comprising a shaft mounted between adjacent ones of said link members connected to a leg, and a crank rotatably mounted to said shaft, and wherein the outer end of at least one of said support strut members is pivotally mounted to said crank.

4. The quickly erectable canopy shelter according to claim 3, wherein said shaft is a telescoping shaft.

5. The quickly erectable canopy shelter according to claim 2, wherein the outer end of at least one of said support strut members is pivotally connected to a corresponding one of said link members adjacent to a leg.

6. The quickly erectable canopy shelter according to claim 1, wherein said legs comprise upper and lower sections.

7. The quickly erectable canopy shelter according to claim 6, wherein said plurality of legs further comprises a slider member slidably mounted to each of said legs.

8. The quickly erectable canopy shelter according to claim 7, wherein each said slider member is mounted to said upper section of said plurality of legs.

9. The quickly erectable canopy shelter according to claim 1, wherein each of said pole members comprises a plurality of pole sections hingedly joined together.

10. The quickly erectable canopy shelter according to claim 1, wherein said extendible perimeter assembly of link members comprises a plurality of pairs of link members being pivotally connected together.

11. The quickly erectable canopy shelter according to claim 10, wherein said plurality of pairs of link members are pivotally connected together in a scissors configuration so as to be extendable from a first collapsed position extending between adjacent pairs of legs to a second extended position extending substantially horizontally between said adjacent pairs of legs.

12. The quickly erectable canopy shelter according to claim 11, wherein said pairs of link members between adjacent pairs of legs are connected together at their inner ends.

13. The quickly erectable canopy shelter according to claim 10, wherein said plurality of legs further comprises a slider member slidably mounted to each of said legs, and said plurality of pairs of link members comprises first and second link members, said first link member having an outer end pivotally connected to the upper end of one said leg, and said second link member having an outer end pivotally connected to one said slider member.

* * * * *